United States Patent [19]

Gordan et al.

[11] Patent Number: 4,656,946

[45] Date of Patent: Apr. 14, 1987

[54] RIFLE LAUNCHED AMMUNITION FOR MOB DISPERSION

[75] Inventors: Tsvi J. Gordan; Shmuel Sorek, both of Jerusalem, Israel

[73] Assignee: The State of Israel, Ministry of Defence, Israel Military Industries, Ill.X

[21] Appl. No.: 619,343

[22] Filed: Jun. 11, 1984

[51] Int. Cl.[4] ..... F42B 13/50

[52] U.S. Cl. ..... 102/438; 102/483; 102/502; 102/529

[58] Field of Search ..... 102/430, 438, 444–447, 102/501, 529, 502, 340, 342, 351, 357, 439, 483–485; 42/1 F, 105

[56] References Cited

U.S. PATENT DOCUMENTS

| | | | |
|---|---|---|---|
| 2,767,656 | 10/1956 | Zeamer | 102/438 |
| 3,732,862 | 5/1973 | Johnson | 102/529 |
| 4,154,012 | 5/1979 | Miller | 102/483 |
| 4,212,244 | 7/1980 | Flatau | 102/438 |

FOREIGN PATENT DOCUMENTS

| | | | |
|---|---|---|---|
| 2425621 | 1/1980 | France | 102/438 |
| 553823 | 6/1943 | United Kingdom | 102/444 |

*Primary Examiner*—Harold J. Tudor

*Attorney, Agent, or Firm*—Steinberg & Raskin

[57] ABSTRACT

An arrangement for mob dispersion includes a cannister which is attachable to the flash suppressor, or grenade launcher adaptor. The cannister contains ammo in the shape of short rubber cylinders stacked on one another to form several cylindrical columns.

5 Claims, 4 Drawing Figures

RIFLE LAUNCHED AMMUNITION FOR MOB DISPERSION

BACKGROUND OF THE INVENTION

1. Field of the Invention

The present invention generally relates to means for mob dispersion and more particularly to rifle launched rubber ammunition for mob dispersion.

2. Description of the Prior Art

There are several factors that must be taken into consideration when designing any kind of arrangement for dispersing a crowd or mob. One is that it be effective, i.e. disperse a reasonably large crowd without injury to either the security force or the people to be dispersed. To this end it is important that the security force, e.g. soldiers or policemen be sufficiently far from the crowd so as not to be injured by them directly or by throwing objects, such as stones. The range of stone throwing is about 30–40 meters. Thus it is unwise for security people to get any closer to the mob, to contact demonstrators with clubs or the like which can and often do result in serious, if not fatal injuries.

There are other means known as "soft" means against demonstrators. These include sprays of water or tear gas. However, they are of limited effect either because of the equipment they require or because they are highly sensitive to wind directions.

A need therefore exists for an improved arrangement for dispersing crowds which does not suffer from the limitations of the prior art.

OBJECTS AND SUMMARY OF THE INVENTION

In accordance with the present invention an arrangement is provided comprising:

a cannister adapted to be supported at the end of a barrel of a grenade launching type rifle, said cannister containing a plurality of rubber projectiles, arranged in columnar fashion whereby subject to pressure in the cannister to gases, said rubber projectiles, are ejected out of said cannister and spread toward people to be dispersed.

In a preferred embodiment of the invention the rubber projectiles are in the shape of short cylinders, mounted on one another in a pattern of several elongated cylinders. It has been found that when so arranged the effectiveness of the arrangement is greatly enhanced.

In yet another preferred embodiment, each rubber projectile has embedded therein a metal slug for increased effectiveness.

The novel features of the invention are set forth with particularity in the appended claims. The invention will best be understood from the following description when read in conjunction with the accompanying drawings.

DETAILED DESCRIPTION OF THE PREFERRED EMBODIMENTS

Figure 1:
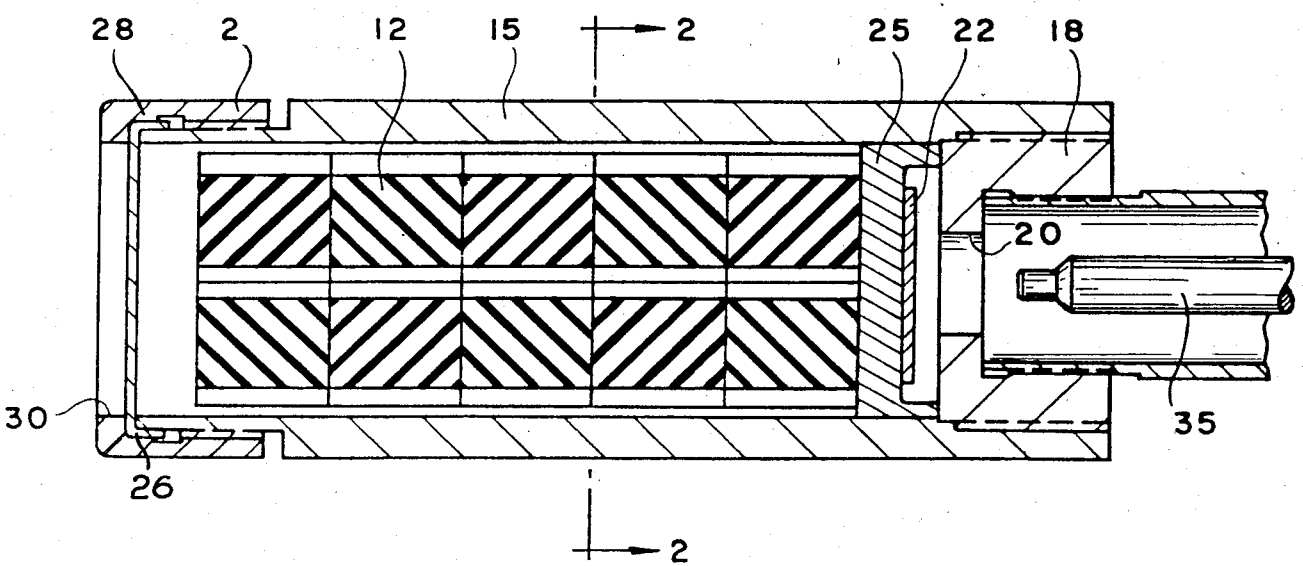
FIG. 1 is a cross-sectional view of one embodiment of the invention take along line 1—1 of FIG. 2.
Figure 2:
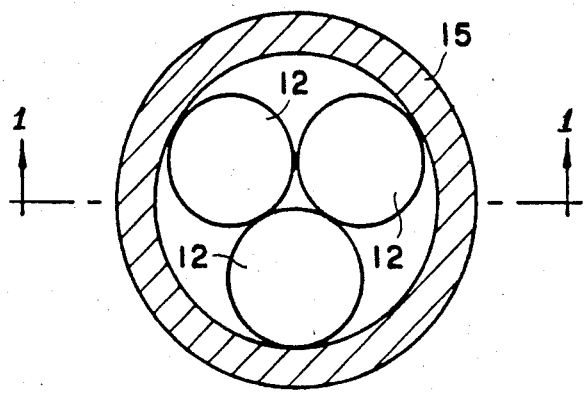
FIG. 2 is a cross-sectional view along line 2—2 in FIG. 1.

Attention is now directed to FIGS. 1 and 2. FIG. 2 is a cross-sectional view along line 2—2 in FIG. 1. Basically, the novel arrangement for crowd dispersal, hereinafter simply referred to as the system, consists of a plurality of rubber projectiles 12 which are arranged in a unique manner in a container or cannister 15. As shown in the Figures the rubber projectiles are cylindrically shaped and mounted on one another to form three elongated cylindrical columns, as clearly shown in FIGS. 1 and 2.

The cannister 15, loaded with rubber projectiles 12, comprises at its aft end means for mounting the cannister on a flash suppressor or grenade launching adaptor of a launching rifle. The mounting means includes an annular adjusting member 18 which itself is threaded into the aft end of cannister 15. A central opening 20 is formed in annular member 18. Aligned with opening 20 is a disc 22 which abuts against a piston 25. A cartridge 35 is provided which serves to launch the rubber projectiles 12.

At the other end of the cannister 15, defined as the fore end, a cover plate 26 is secured to the cannister by a threaded holder 28, with a large central opening 30. Prior to firing a ballistic launching cartridge 35, of the type used to fire rifle grenades, the cannister 15 is loaded with the rubber projectiles 12 in cannister 15, which is airtight. As the cartridge 35 is fired the gases which are created produce a force generally axially directed. The force is sufficient to force disc 22 to push piston 25 against projectiles 12 which in turn burst the cover plate 26 and thus become ejected out of the cannister through opening 30. As they exit the cannister they tend to break up from their columnar arrangement and spread out so as to impinge upon and disperse a crowd, larger than before, with an equal number of units.

Figure 3:
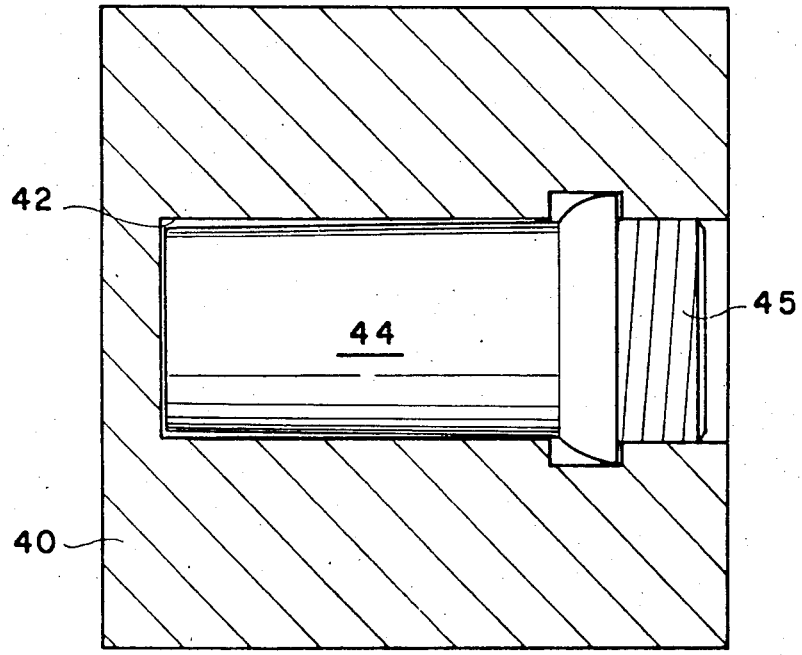
FIG. 3 is a cross-sectional view of a preferred projectile.

It should be stressed that although herebefore the rubber projectiles were shown as cylindrical, arranged on top of one another to form three large cylindrical columns, the invention is not limited thereto. One of the basic advantages realized from the invention is due to arranging the units on top of one another to form several columns along the cannister. When so arranged, their effectiveness in term of range and impact are greatly increased. Herebefore each projectile 12 was assumed to be of rubber only. In another embodiment of the invention the rubber unit, designated in FIG. 3 by 40, is shaped with a recess 42 in which a steel pin 44 is insertable and plugged by a rubber plug 45. Such a unit 40 may be preferred because of its added impact and effective range.

Figure 4:
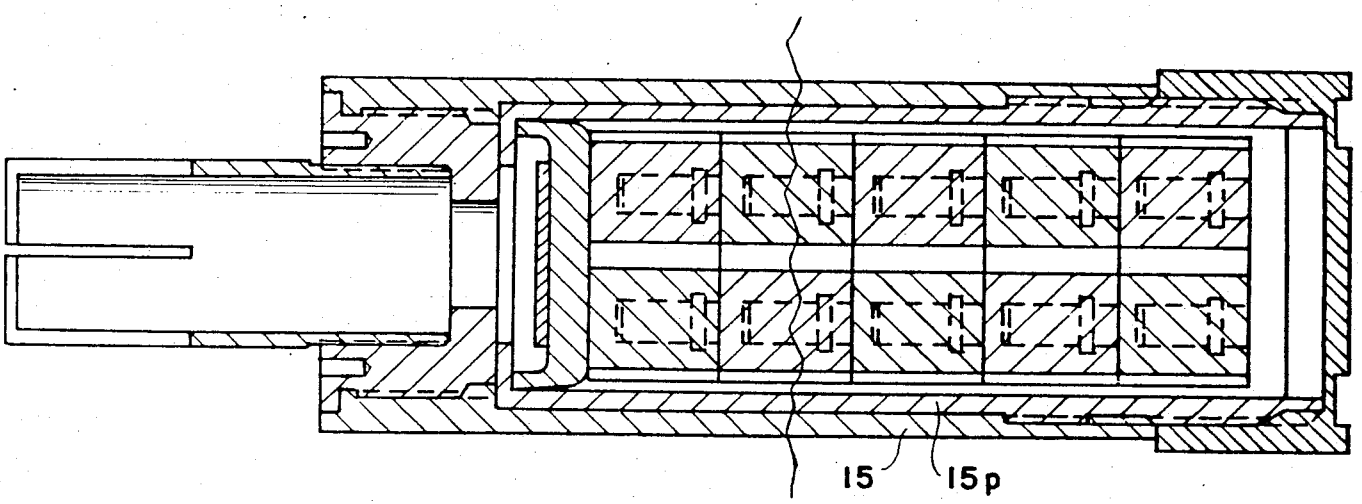
FIG. 4 is a cross-sectional view of another embodiment of the invention.

In the foregoing it was assumed that the rubber projectiles are directly loaded into the cannister. Thus, after each firing a new cannister has to be reloaded and remounted on the rifle. In accordance with another aspect, as shown in partial view in FIG. 4, the projectiles are loaded into a plastic cannister **15*p*, which is in turn insertable into a metal cannister 15. Thus after firing, a new plastic cannister 15*p***, loaded with projectiles, can be reloaded into the metal cannister for greater firing rate, since the metal cannister need not be removed from the rifle, but merely reloaded by a loaded plastic cannister.

It should be pointed out that when projectile units with metal inserts are used they should be loaded so that the plugs face the cover at the fore end.

It should be stressed that the novel invention is totally safe to the user. The magnitude of force applied to a demonstrator is very effective to disperse a crowd with no or only minimal danger as long as the invention is used at the recommended range for the particular rifle and ammunition.

Although particular embodiments of the invention have been described and illustrated herein, it is recognized that modifications and variations may readily occur to those skilled in the art and consequently, it is intended that the claims be interpreted to cover such modifications and equivalents.

We claim:

1. An arrangement for dispersing crowds, comprising:

a cannister having aft and fore ends and defining an interior space therewithin;

a plurality of projectiles formed of elastomeric material, each projectile having a pair of opposed planar end surfaces, said projectiles being situated in said interior space of said cannister to form at least one column of projectiles with planar end surfaces of each pair of adjacent projectiles in mutual abutting relationship;

means provided at said aft end of said cannister for mounting said cannister at an end and externally of a barrel of a launching rifle;

a piston situated in said interior of said cannister near said aft end thereof;

passage means for conducting propellant gases from the rifle to act on said piston; and burstable sealing means for closing said fore end of said cannister, said sealing means being burstable by said projectiles upon launching such that said at least one column of projectiles is launched through said fore end of said cannister.

2. The combination of claim 1 wherein each of said projectiles has a cylindrical shape.

3. The combination of claim 1 wherein each of said projectiles includes a metallic pin extending axially therein.

4. The combination of claim 1 wherein said cannister mounting means include means for mounting said cannister on a flash suppressor situated at the end of the barrel of the launching rifle.

5. The combination of claim 1 wherein said projectiles are situated in said interior space of said cannister to form three substantially parallel columns of projectiles, each of said projectile columns being situated contiguous to the other two of said columns.

* * * * *

UNITED STATES PATENT AND TRADEMARK OFFICE

CERTIFICATE OF CORRECTION

PATENT NO. : 4,656,946

DATED : April 14, 1987

INVENTOR(S) : Tsvi Joseph Gordon et al

It is certified that error appears in the above-identified patent and that said Letters Patent is hereby corrected as shown below:

Title page, item (19) "Gordan et al" should be --Gordon et al --.

Item (75) inventors should read

-- Tsvi J. Gordon; Shmuel Sorek, both of Jerusalem, Israel --.

Signed and Sealed this

Twenty-ninth Day of March, 1988

*Attest:*

DONALD J. QUIGG

*Attesting Officer*

*Commissioner of Patents and Trademarks*